US006614153B2

(12) United States Patent
Bae et al.

(10) Patent No.: US 6,614,153 B2
(45) Date of Patent: Sep. 2, 2003

(54) MASK FOR COLOR PICTURE TUBE

(75) Inventors: Chul-han Bae, Seoul (KR); Nozomu Arimoto, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 100 days.

(21) Appl. No.: 09/900,890

(22) Filed: Jul. 10, 2001

(65) Prior Publication Data

US 2002/0005688 A1 Jan. 17, 2002

(30) Foreign Application Priority Data

Jul. 12, 2000 (KR) ..... 2000-39984

(51) Int. Cl.[7] ..... H01J 29/80
(52) U.S. Cl. ..... 313/402; 313/403
(58) Field of Search ..... 313/402–408

(56) References Cited

U.S. PATENT DOCUMENTS 3,638,063 A 1/1972 Tachikawa et al.
4,926,089 A 5/1990 Moore
4,942,332 A 7/1990 Adler et al.
4,973,283 A 11/1990 Adler et al.
6,225,736 B1 * 5/2001 Gorog ..... 313/407
6,388,370 B1 * 5/2002 Ohmae ..... 313/403
2001/0008359 A1 * 7/2001 Ohmae et al. ..... 313/402
2001/0015607 A1 * 8/2001 Kobayashi et al. ..... 313/403
2001/0020817 A1 * 9/2001 Inoue et al. ..... 313/461
2001/0052746 A1 * 12/2001 Shin et al. ..... 313/407
2002/0014821 A1 * 2/2002 Kobayashi et al. ..... 313/402
2002/0014822 A1 * 2/2002 Shin et al. ..... 313/408

FOREIGN PATENT DOCUMENTS

JP 52022474 A * 2/1977 ..... H01J/29/07

* cited by examiner

*Primary Examiner*—Ashok Patel
*Assistant Examiner*—German Colón
(74) *Attorney, Agent, or Firm*—Robert E. Bushnell, Esq.

(57) ABSTRACT

A tension mask for a color picture tube includes a plurality of strips separated a predetermined distance from each other and parallel to each other, and a plurality of real bridges for connecting the neighboring strips and forming slots through which electron beams pass, the number of the real bridges gradually decreasing from the central portion of the tension mask to the peripheral portion thereof.

23 Claims, 9 Drawing Sheets

MASK FOR COLOR PICTURE TUBE

CLAIM OF PRIORITY

This application makes reference to, incorporates the same herein, and claims all benefits accruing under 35 U.S.C. §119 from my application *MASK FOR COLOR PICTURE TUBE* filed with the Korean Industrial Property Office on Jul. 12, 2000 and there duly assigned Ser. No. 39984/2000.

BACKGROUND OF THE INVENTION

1. Technical Field

The present invention relates to a color picture tube, and more particularly, to a mask which is installed close to a fluorescent film at the inner side of a panel and performs a color selection function.

2. Related Art

In a color picture tube adopted in computer monitors or televisions, three electron beams are emitted from an electron gun and pass through electron beam passing holes of a mask having a color selection function. Then, the electron beams land on red, green and blue fluorescent substances on a fluorescent film formed on a screen surface of a panel to excite the fluorescent substance so that an image is formed.

In the above color picture tube for forming an image, the mask having a color selection function is divided into a dot mask used for computer monitors and a slot mask (or a slit mask) used for televisions. Since the screen surfaces are formed to have predetermined curvatures considering landing of deflected electron beams, the dot mask and slot mask are designed to have curvatures corresponding to those of the screen surfaces.

The above masks are formed of a thin plate having a thickness of 0.1 through 0.25 millimeters (mm) and a plurality of electron beam passing holes are formed therein by etching the thin plate. Then, the thin plate is formed to have a predetermined curvature. When the mask does not have a predetermined curvature or more, mechanical intensity of the mask deteriorates so a permanent plastic deformation can be generated to the mask due to impacts occurring during production of picture tubes or transfer thereof. As a result, the color selection function which is an intrinsic function of the mask may not be properly performed. Also, the mask formed to have a predetermined curvature is supported by a frame installed on an inner surface of the panel. The mask is easily heated by thermions emitted by the electron gun and thermally expands. Accordingly, a doming phenomenon occurs so that the color selection function with respect to the three electron beams cannot be performed.

As the size of a color picture tube recently increases, an image is distorted due to the curvature of a screen surface and a natural image does not get smoothly represented, so that a flat screen surface is required.

Slot type masks for preventing the doming phenomenon and enabling a flat screen surface are disclosed in U.S. Pat. No. 3,638,063 to Tachikawa et al., entitled GRID STRUCTURE FOR COLOR PICTURE TUBES, issued on Jan. 25, 1972, U.S. Pat. No. 4,942,332 to Adler et al., entitled TIED SLIT MASK FOR COLOR CATHODE RAY TUBES, issued on Jul. 17, 1990, U.S. Pat. No. 4,926,089 to Moore, entitled TIED SLIT FOIL SHADOW MASK WITH FALSE TIES, issued on May 15, 1990, and U.S. Pat. No. 4,973,283 to Adler et al., entitled METHOD OF MANUFACTURING A TIED SLIT MASK CRT, issued on Nov. 27, 1990. Of the disclosed masks, an aperture grille type mask is shown in FIG. 1.

Referring to FIG. 1, the aperture grille type mask 10 includes strips 11 which are separated a predetermined distance from one another and parallel to each other and form slots. In the mask 10, both end portions of each of the strips 11 are supported at a frame 12 to have tension. Each of strips 11 contacts damper wires 13 to prevent independent vibration of each strip. However, such a mask is difficult to handle during a manufacturing process since it has a structure in which the strips 11 are parallel to each other and only both end portions of the strips 11 are fixed.

To solve the above problem, as shown in FIG. 2, an example of a slot type mask has been suggested in U.S. Pat. No. 4,942,332. As shown in the drawing, in the slot type mask, a plurality of strips 22 and 22' forming a slit 21 are formed on a thin plate by being separated a predetermined distance and the strips 22 and 22' are connected by tie bars 23. Thus, since the strips 22 and 22' are connected by the tie bars 23, howling generated by vibrations due to impacts and sonic waves applied from the outside can be slightly reduced. Nevertheless, the howling reducing effect cannot be expected much since the vibrations of the tie bars 23 are transferred by the tie bars 23 through the neighboring strips.

FIG. 3 shows a mask having false ties disclosed in U.S. Pat. No. 4,926,089. As shown in the drawing, in a mask 30, strips 31 and 31' installed parallel to each other is connected by a tie bar 32 for forming a slot 33. A plurality of false ties 34 extending from the strips 31 and 31' and not contacting the adjacent strops 31 and 31' are positioned in the slot 33 between the tie bars 32.

In the above mask 30, visibility of an image is improved by disposing the false ties 34 between the tie bars 32. However, since the strips 31 and 31' are connected by the tie bars 32, a problem that vibrations generated by an impact applied to a portion are transferred to a neighboring strip cannot be solved.

In particular, in the above mask type, a moire phenomenon occurs because scanned electron beams and the holes of the mask are interfered with each other. The moire phenomenon becomes serious at the peripheral portion of a screen because the shape of a spot of an electron beam landing on a fluorescent film is deformed to be horizontally elongated due to a strong pincushion magnet field by a deflection yoke as a deflection angle of an electron beam increases. Accordingly, methods of selecting a mask pitch at which the moire phenomenon is minimized or reducing a vertical pitch to reduce is used to reduce the depth of modulation, are used. However, the above methods are not recommended because transmissivity at the periphery portion of the mask is lowered and the brightness of a screen is not uniform.

Also, in the mask method, a mask doming phenomenon becomes serious as the mask is heated by the electron beams. Furthermore, the doming phenomenon easily occurs at the peripheral portion of a mask. In the case of a tension mask, when a steel frame which is cheap is used, the mask including a mask bridge portion extends in a horizontal direction so that color escape in a wrinkle shape is generated on a screen.

SUMMARY OF THE INVENTION

To solve the above problems, it is an object of the present invention to provide a tension mask for a color picture tube which can improve a vibration reduction effect by reducing transfer of vibrations between electron beam strips.

It is a further object of the present invention to provide a tension mask which can reduce a moire phenomenon due to interference between the scanned electron beam and holes of a mask and reduce a doming phenomenon of the mask, and improve brightness of an image.

Accordingly, to achieve the above objects and others, there is provided a tension mask for a color picture tube comprising a plurality of strips separated a predetermined distance from each other and parallel to each other, and a plurality of real bridges for connecting the neighboring strips and forming slots through which electron beams pass, the number of the real bridges gradually decreasing from the central portion of the tension mask to the peripheral portion thereof. The electron beams pass through the slots or penetrate the slots.

It is preferred in the present invention that the real bridge is not formed between an end strip located at the outermost portion of the tension mask in a horizontal direction and a strip adjacent thereto.

Also, it is preferred in the present invention that a plurality of dummy bridges extending from the strips in the opposite directions to face each other but not physically contacting each other, are disposed between the real bridges connecting the strips.

Also, to achieve the above objects and others, there is provided a tension mask for a color picture tube comprising a real ridge area located at the central portion of the tension mask, in which a plurality of strips separated a predetermined distance from each other and parallel to each other and a plurality of real bridges for connecting the neighboring strips and forming slots through which electron beams pass, the number of the real bridges gradually decreasing from the central portion of the tension mask to the peripheral portion thereof, are formed, and a dummy bridge area located at the peripheral portion of the tension mask, in which a plurality of dummy bridges extending from at least one side of each of the strips but not physically contacting the opposite strip, are formed, wherein the tension mask is a hybrid type. When the term "hybrid type" is used to describe the tension mask, that tension mask is a combination of a real bridge area, a dummy bridge area, and an aperture grill area.

It is preferred in the present invention that the dummy bridge area further includes real bridges for connecting the neighboring strips, the number of the real bridges gradually decreasing from the central portion of the tension mask to the peripheral portion thereof.

Alternatively, to achieve the above objects and others, there is provided a tension mask for a color picture tube comprising a real bridge area located at the central portion of the tension mask, in which a plurality of strips separated a predetermined distance from each other and parallel to each other and a plurality of real bridges for connecting the neighboring strips and forming slots through which electron beams pass, the number of the real bridges gradually decreasing from the central portion of the tension mask to the peripheral portion thereof, are formed, and a dummy bridge area located at the peripheral portion of the tension mask, in which a plurality of dummy bridges extending from at least one side of each of the strips but not physically contacting the opposite strip, are formed, and an aperture grille area located around the dummy bridge area and having a single slot formed by the strips, wherein the tension mask is a hybrid type.

To achieve these and other objects in accordance with the principles of the present invention, as embodied and broadly described, the present invention provides a tension mask apparatus for a color picture tube, the apparatus comprising: a plurality of strips being separated a predetermined distance from each other and being substantially parallel to each other; and a plurality of real bridges connecting adjacent ones of said strips and forming slots through which electron beams pass, a quantity of said real bridges gradually decreasing from a central portion of said tension mask to a peripheral portion of a tension mask.

To achieve these and other objects in accordance with the principles of the present invention, as embodied and broadly described, the present invention provides a tension mask apparatus for a color picture tube, the apparatus comprising: a first plurality of strips being separated a predetermined distance from each other and being parallel to each other, said first plurality of strips being located in a real bridge area, said real bridge area being located at a central portion of a tension mask; a plurality of real bridges connecting adjacent ones of said first plurality of strips and forming first slots separating said first plurality of strips, a number of said real bridges gradually decreasing in a first direction from said central portion of said tension mask toward a peripheral portion of said tension mask, said plurality of real bridges being located in said real bridge area; a second plurality of strips being separated a predetermined distance from each other and being parallel to each other, said dummy bridge area forming second slots separating said second plurality of strips, said second plurality of strips being located in a dummy bridge area, said dummy bridge area being located at said peripheral portion of said tension mask; and a plurality of dummy bridges, each of said dummy bridges extending in opposite directions into said second slots from adjacent ones of said second plurality of strips, said plurality of dummy bridges being located in said dummy bridge area, said tension mask being a hybrid type tension mask.

To achieve these and other objects in accordance with the principles of the present invention, as embodied and broadly described, the present invention provides a tension mask apparatus for a color picture tube, comprising: a plurality of strips being separated a predetermined distance from each other and being parallel to each other; a real bridge area being located at a central portion of a tension mask, said real bridge area comprising a plurality of real bridges connecting neighboring ones of said strips in said real bridge area and forming slots through which electron beams pass, said real bridges being formed to gradually decrease in number in a direction from said central portion of said tension mask to a peripheral portion of said tension mask; a dummy bridge area being located at said peripheral portion of said tension mask, said dummy bridge area comprising a plurality of dummy bridges extending from at least one side of each of said strips in said dummy bridge area and not physically contacting the opposite strip; and an aperture grille area being located near said dummy bridge area and having at least one slot formed by said strips, said tension mask being a hybrid type.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 1:
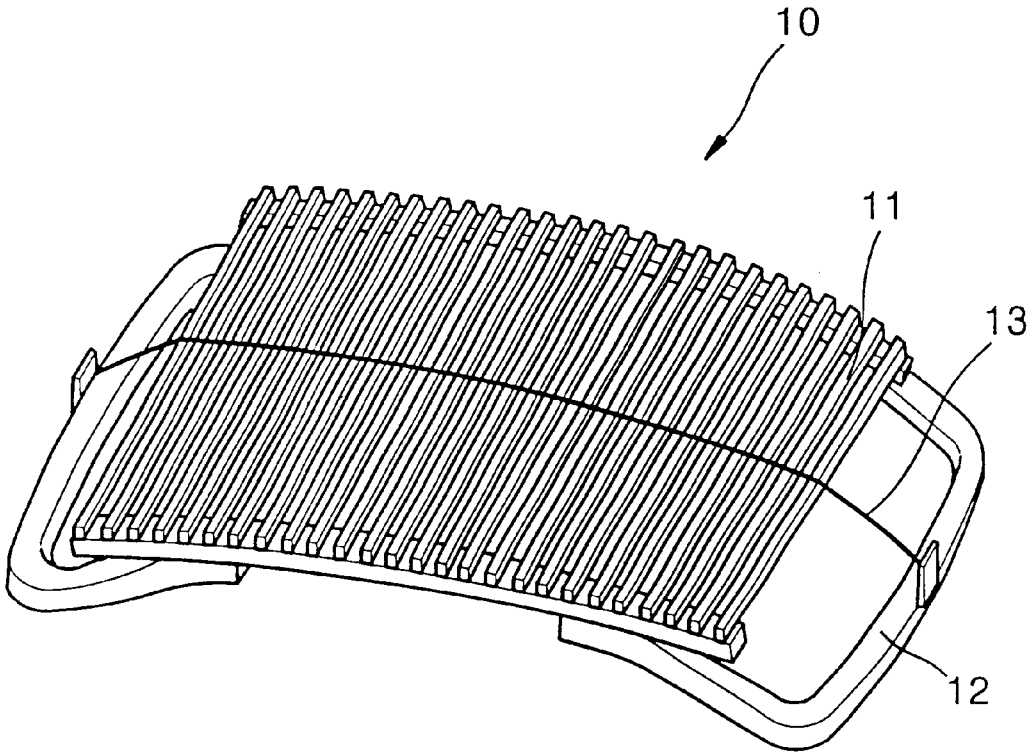
FIG. 1 (PRIOR ART)
FIG. 1 is a perspective view of a mask frame assembly.
Figure 2:
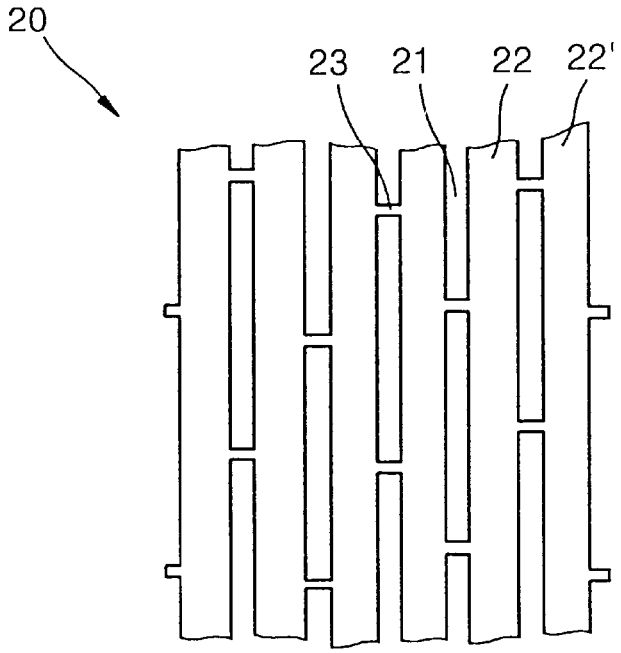
FIG. 2 (PRIOR ART)
FIG. 2 is an enlarged plan view of another mask.
Figure 3:
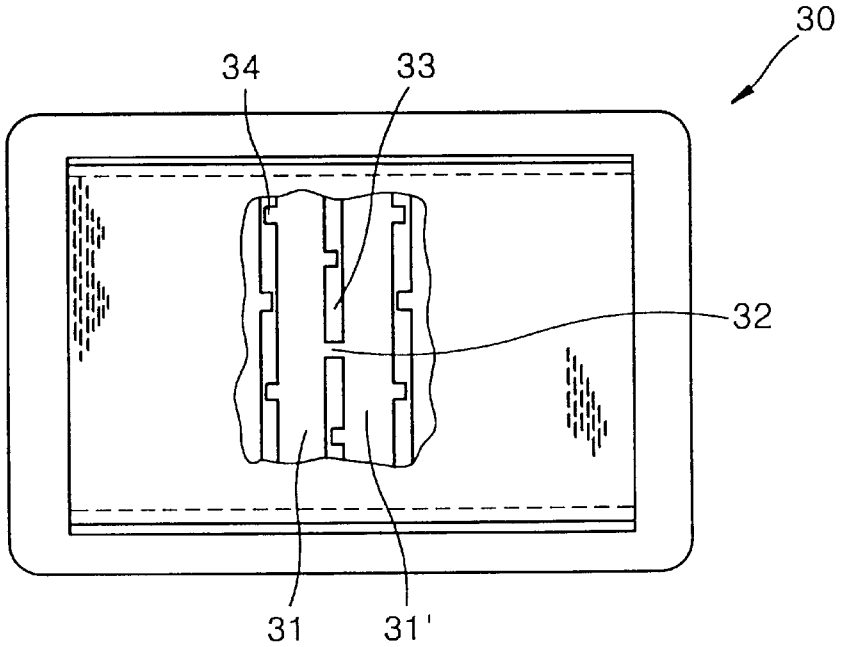
FIG. 3 (PRIOR ART)
FIG. 3 is a plan view of yet another mask.
Figure 4:
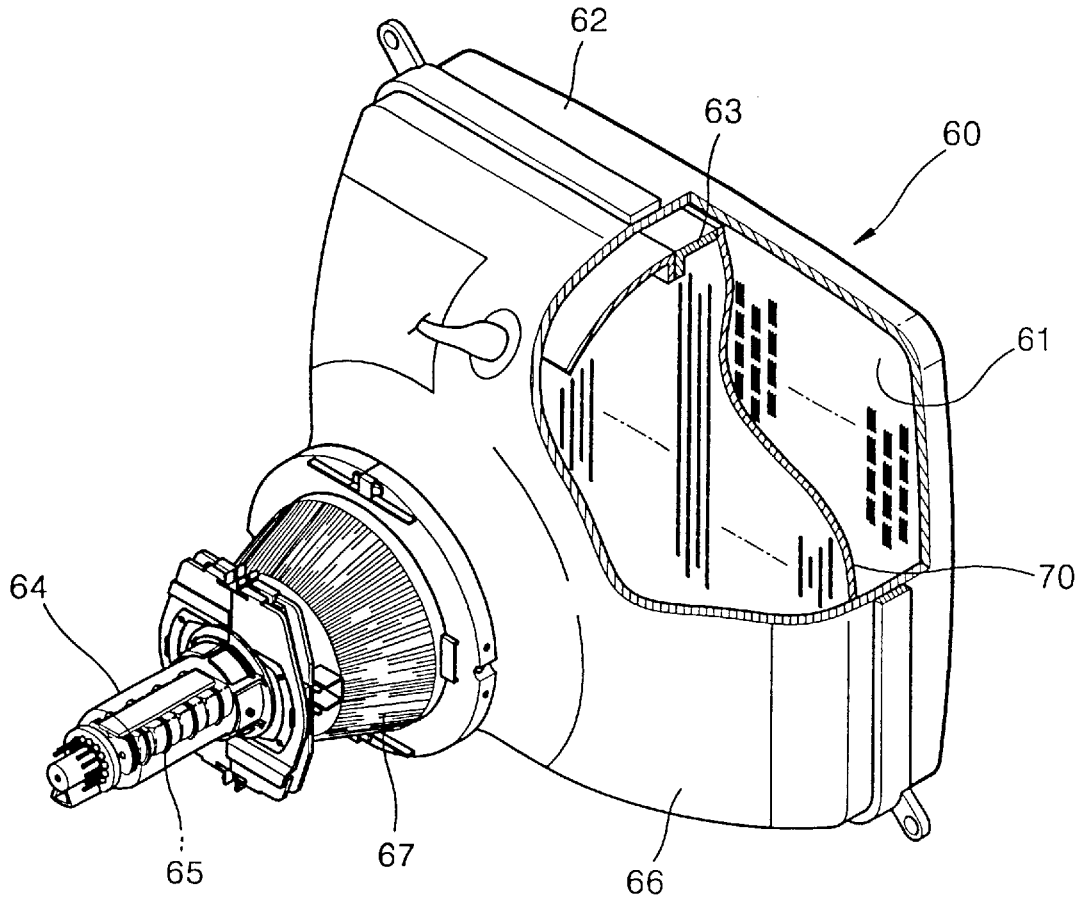
FIG. 4 is a partially cut-away perspective view of a color picture tube, in accordance with the principles of the present invention.

FIG. 4 is a partially cut-away perspective view of a color picture tube, in accordance with the principles of the present invention. FIG. 4 shows a picture tube including a tension mask according to a preferred embodiment of the present invention. As shown in the drawing, a color picture tube 60 includes a panel 62 having a fluorescent film 61 of a predetermined pattern formed on an inner surface thereof, a tension mask 70 installed on the inner surface of the panel 62 with tension applied, so that three electron beams can accurately land on a fluorescent layer of the fluorescent film 61, and a frame 63 supported by the panel 62 for supporting the tension mask 70 so that tension can be applied to the tension mask 70. The panel 62 is coupled to a funnel 66 forming a seal and the funnel 66 as a neck portion 64 where an electron gun 65 is installed. A deflection yoke 67 for deflecting electron beams emitted from the electron gun 65 to have the deflected electron beams accurate land on the fluorescent layer, is installed at the neck portion 64 and a cone portion of the funnel 66.

Figure 5:
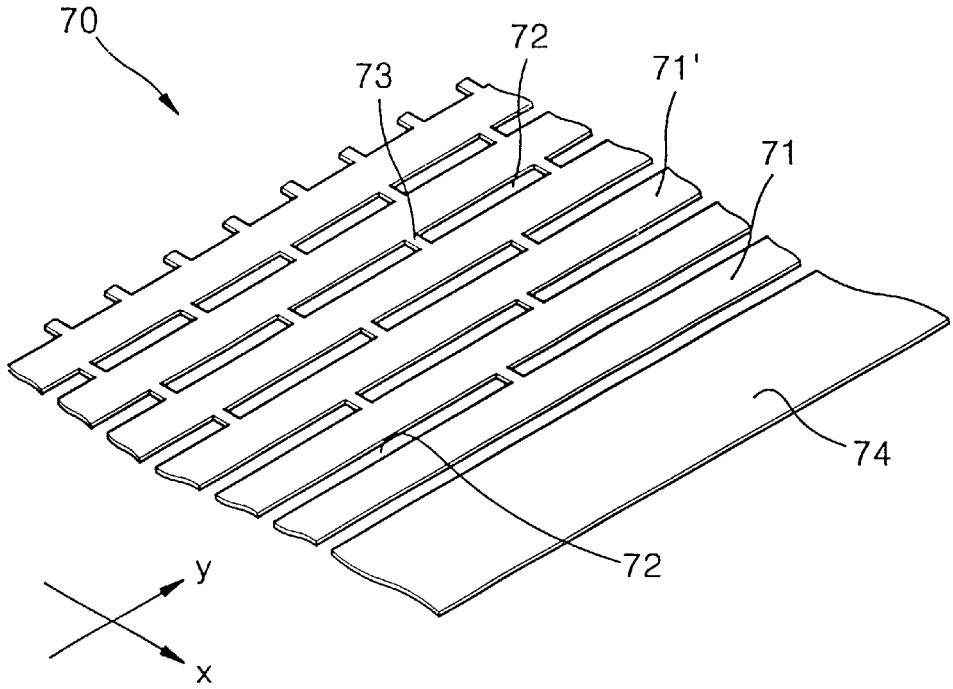
FIG. 5 is a partially cut-away perspective view of a first embodiment of a mask, in accordance with the principles of the present invention.

In the above picture tube, a tension mask having a color selection function so that three electron beams can accurately land n the fluorescent film is shown in FIG. 5. FIG. 5 is a partially cut-away perspective view of a firs embodiment of a mask, in accordance with the principles of the present invention. As shown the drawings, a tension mask 70 is formed of a thin plate material and includes a plurality of strips 71 and 71' separated a predetermined distance from each other and parallel to each other, and a plurality of real bridges 73 connecting the neighboring strips 71 and 71' to define slots 72 through which electron beams pass. Here, the number of the real bridges 73 gradually decreases from the central portion of the tension mask 70 to the peripheral portion thereof That is, the vertical pitch of the real bridges 73 gradually increases in a direction X from the central portion of the tension mask 70. The direction X is a horizontal direction perpendicular to the strips. The real bridges 73 decreasing in number along the direction X are randomly arranged so that vibrations cannot be easily transferred from the central portion or the peripheral portion. Here, for the real bridges 73 decreasing in number from the central portion of the tension mask 70 to the peripheral portion thereof, areas in which the real bridges 73 are present in the same number may be present between the central portion of the tension mask 70 to the peripheral portion thereof.

In the tension mask 70, it is preferable that a small quantity of real bridges 73 are formed or no real bridges 73 are formed near an end strip 74 disposed at a top end portion in the direction X of the tension mask 70.

Figure 6:
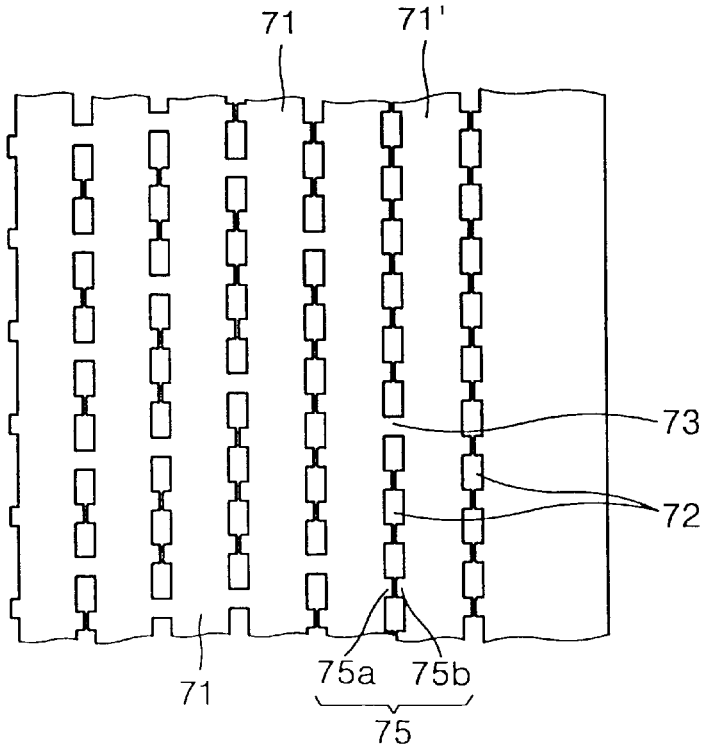
FIG. 6 is a plan view of a mask according to a second embodiment of the present invention.

FIG. 6 is a plan view of a mask according to a second embodiment of the present invention. In the slots 72 defined by the strips 71 and 71' and the real bridges 73, as shown in FIG. 6, there are a plurality of dummy bridges 75 formed by protrusions 75*a* and 75*b* extending from the strips 71 and 71' in the opposite directions to face each other but not physically contact each other. The dummy bridge 75 disposed in the slot 72 may be formed such that a protrusion extends from a strip at one side.

Figure 7:
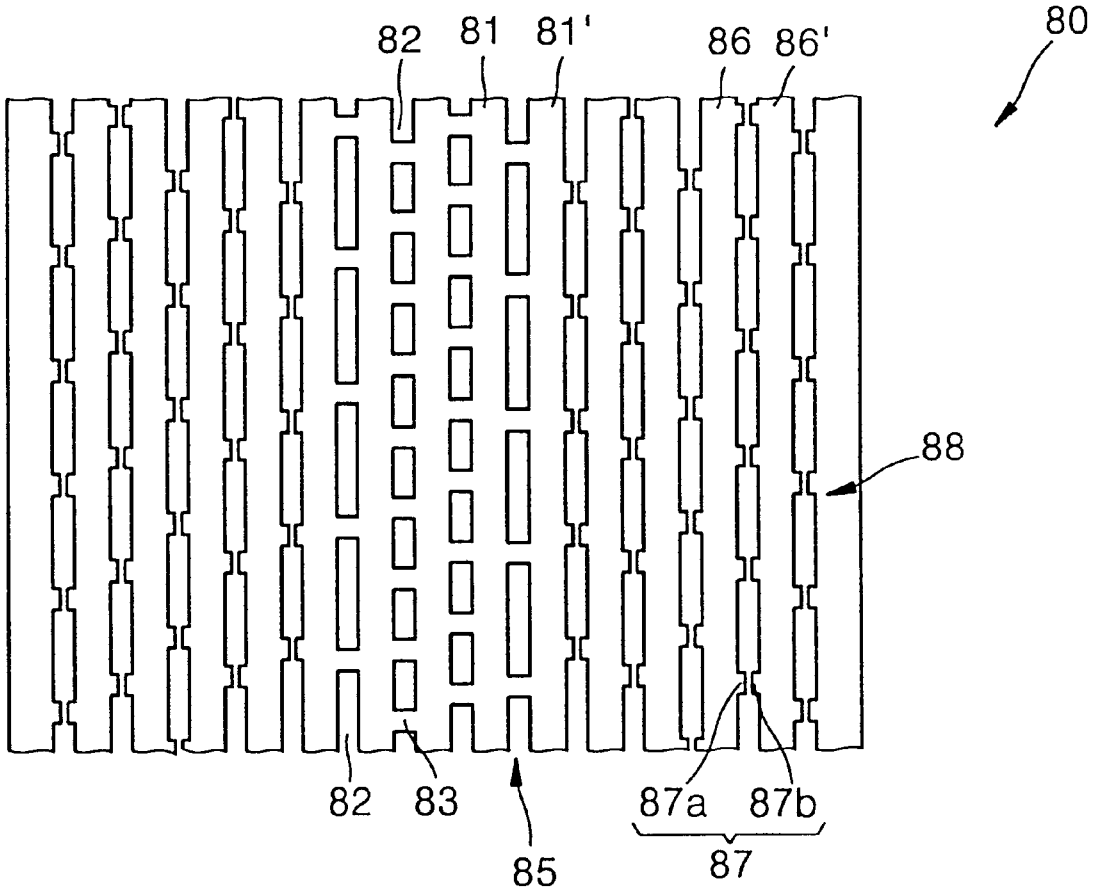
FIG. 7 is a view of a mask according to a third embodiment of the present applicaiton.

FIG. 7 shows a tension mask for a color picture tube according to yet another embodiment of the present invention. FIG. 7 is a view of a mask according to a third embodiment of the present invention. As shown the drawing, a tension mask 80 includes a real bridge area 85 and a dummy bridge area 88 formed at both sides of the real bridge area 85. That is, on both sides of the real bridge area 85 in a direction X. The real bridge area 85 includes a plurality of strips 81 and 81' separated a predetermined distance from each other and parallel to each other and a plurality of real bridges 83 for connecting the strips 81 and 81' to form slots 82 through which electron beams pass. The dummy bridge area 88 where strips 86 and 86' are formed to be separated from each other and to be parallel to each other includes dummy bridges 87 formed of protrusions 87*a* and 87*b* extending from the edges of the strips 86 and 86' in the opposite directions to face each other but not to physically contact each other.

Figure 8:
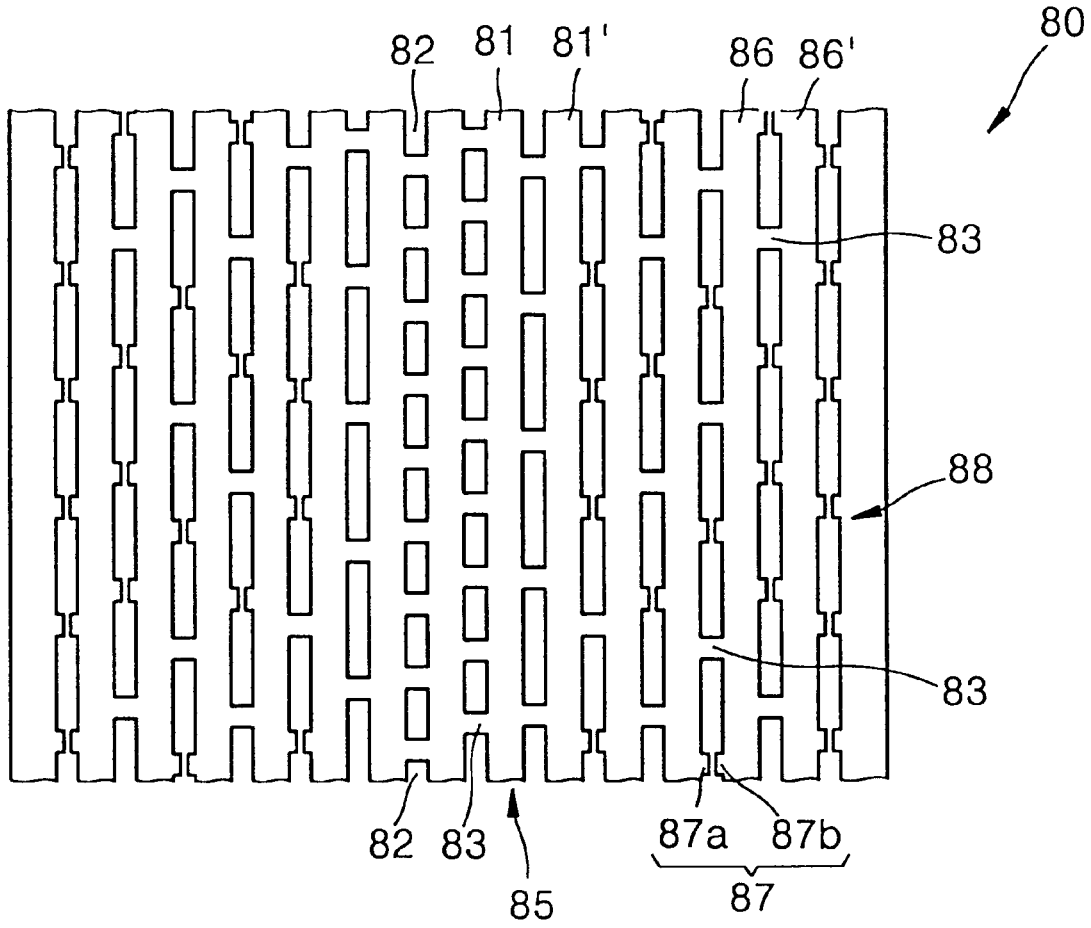
FIG. 8 is a view of a mask according to a fourth embodiment of the present application.

FIG. 8 is a view of a mask according to a fourth embodiment of the present invention. A real bridge 83 can be formed at the dummy bridge area 86, as shown in FIG. 8. In the arrangement of the real bridge 83, the number of real bridges 83 decreases from the central portion of the real bridge area 85 to the peripheral portion thereof along the direction X, so that the pitch of the real bridge gradually increases from the central portion to the peripheral portion. The aforementioned "peripheral portion" of the real bridge area 85 can be referred to as an intermediate area of mask 80, because it separates the central portion of real bridge area 85 from the dummy bridge area 88.

Figure 9:
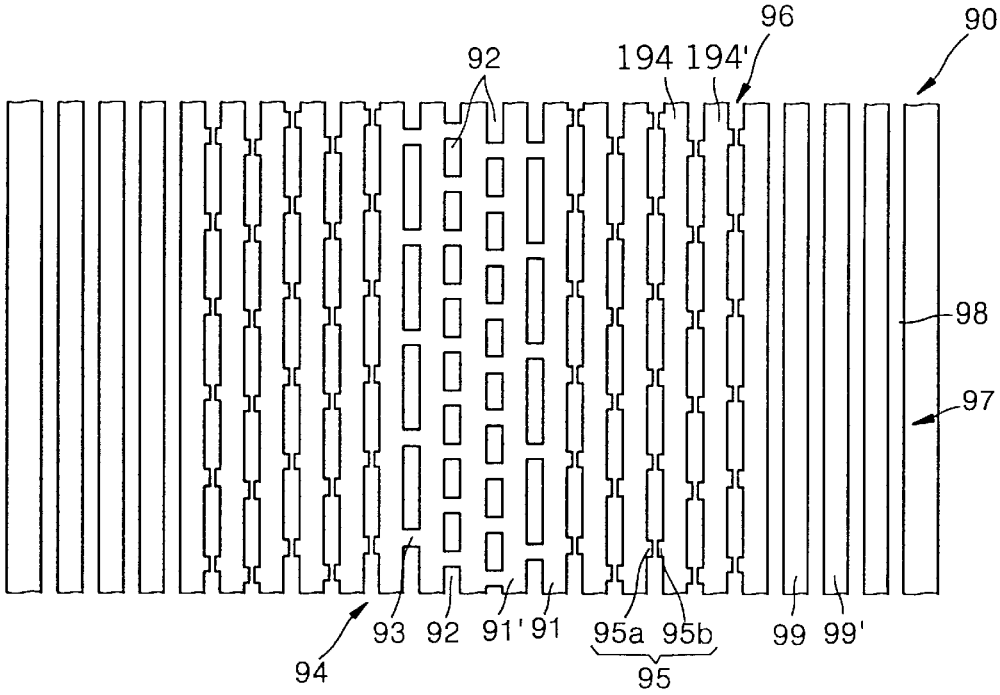
FIG. 9 is a view of a mask according to a fifth embodiment of the present application.

FIG. 9 shows a tension mask for a color picture tube according to another preferred embodiment of the present invention. FIG. 9 is a view of a mask according to a fifth embodiment of the present invention. As shown in the drawing, a tension mask 90 formed of a thin plate includes a real bridge area 94 and a dummy bridge area 96 disposed at both sides of the real bridge area 94. The real bridge area 94 includes a plurality of strips 91 and 91' installed to be separated a predetermined distance from each other at the central portion thereof and parallel to each other, and includes real bridges 93 for connecting the strips 91 and 91' to form slots 92 through which electron beams pass. The dummy bridge area 96 includes strips 94 and 94' separated a predetermined distance from each other and parallel to each other and a dummy bridge 95 formed of protrusions 95*a* and 95*b* extending from the strips 194 and 194' in the opposite directions but not contacting each other. Here, the slot 92 is uniformly divided by the pitch of the dummy bridge 95. The two protrusions 95*a* and 95*b* do not physically contact each other.

Figure 10:
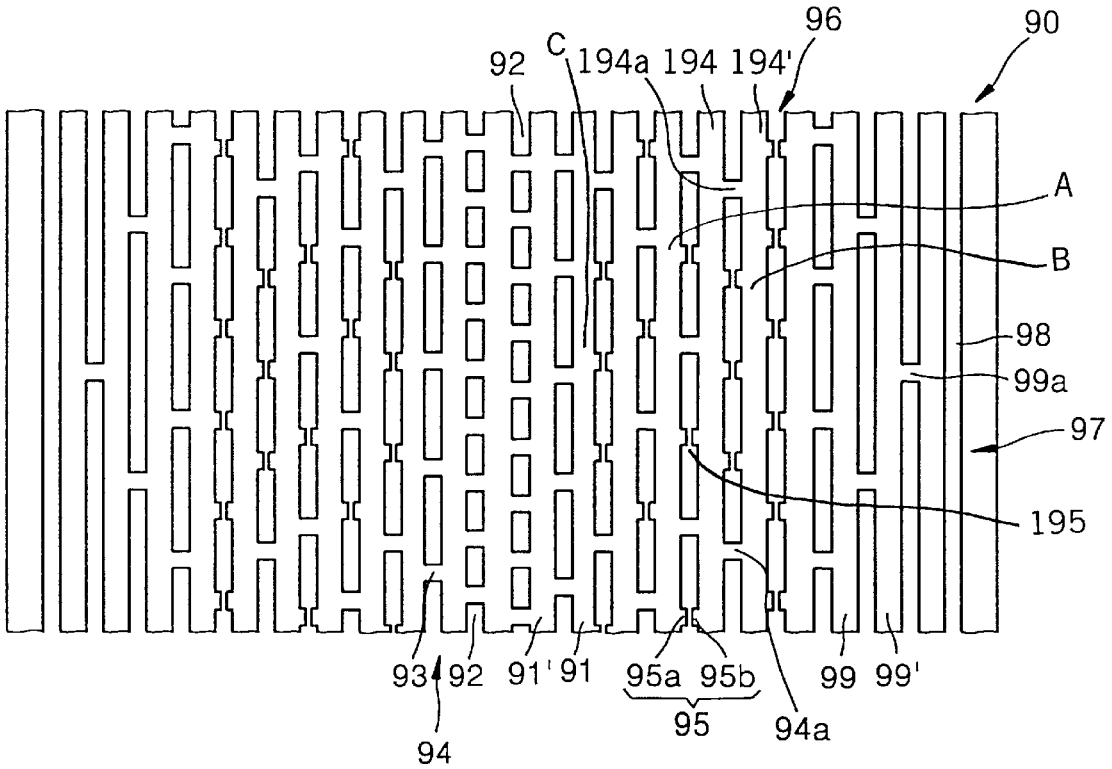
FIG. 10 is a view of a mask according to a sixth embodiment of the present application.
Figure 12:
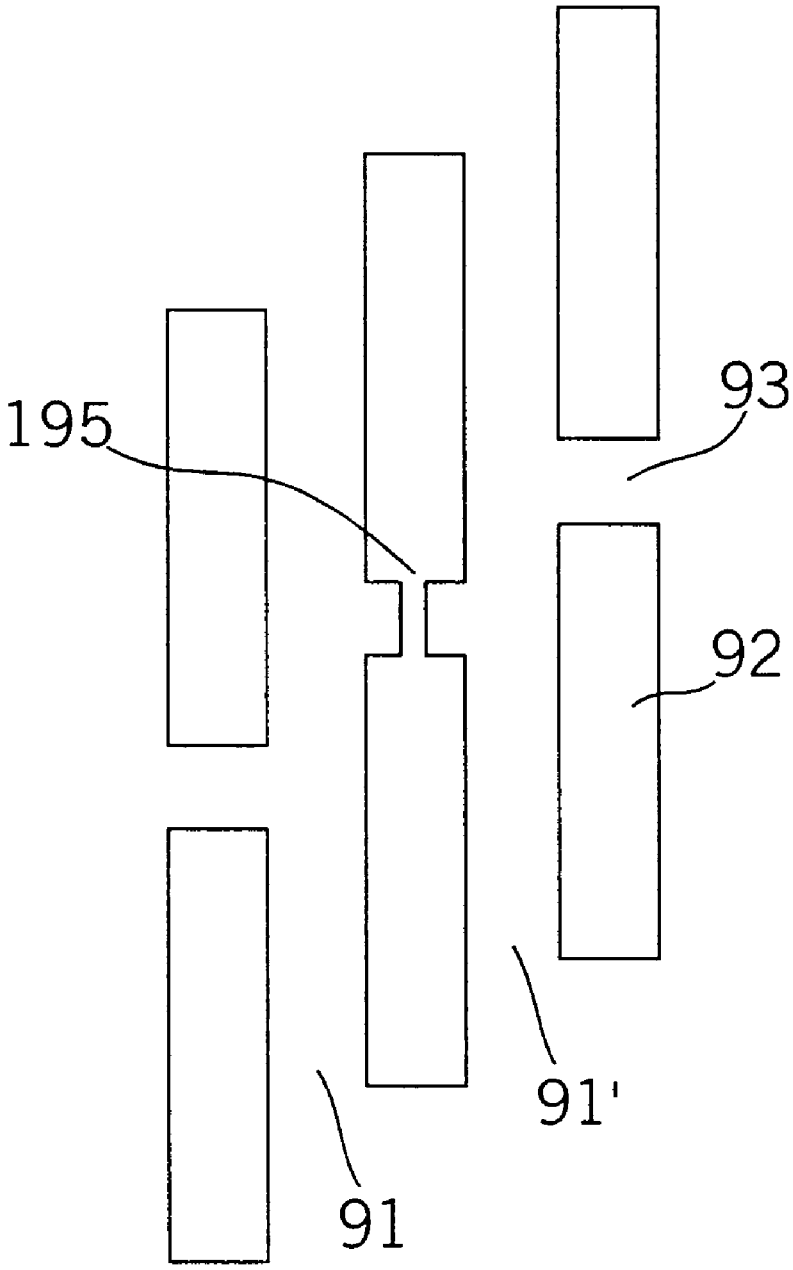
FIG. 12 is a plan view showing a mask according to another preferred embodiment of the present invention.

FIG. 10 is a view of a ask according to a sixth embodiment of the present invention. There is a dummy slot 195 which separates the two protruding portions 95*a* and 95*b*. The dummy slot 195 can be centrally located between the two adjacent strips, as shown in FIG. 10. Or the dummy slot 195 can be closer to one of the two adjacent strips than to the other one of the two adjacent strips, as shown in FIG. 12. The FIG. 12 shows another embodiment of a tension mask in accordance with the principles of the present invention. In FIG. 12, the dummy slot 195 is closer to adjacent strip 91 than it is to adjacent strip 91'. The dummy slot 195 is not centrally located between strips 91 and 91'.

Also, in accordance with the principles of the present invention, the two protrusions 95*a* and 95*b* can be formed by extending from one strip at one side toward the other strip instead of extending inward simultaneously from both of the two strips facing each other.

A real bridge 194*a* for connecting the strips 194 and 194' may be formed at the dummy bridge area 96, as shown in FIG. 10. In this case, the number of the real bridges 194*a* decreases from the real bridge area 94 to the peripheral portion in a direction X.

In the peripheral portion of the dummy bridge area 96, an aperture grille area 97 is formed. The aperture grille area 97 includes strips 99 and 99' installed parallel to each other and forming a single slot 98. The strips 99 and 99' forming the aperture grille area 97, as shown in FIG. 10, can be connected by the real bridges 99*a*. In this case, the number of the real bridges 99*a* decreases from the central portion to the peripheral portion. At least one or none of the real bridges 99*a* are formed between an end strip located at the outermost position and a neighboring strip. In general, the number of the real bridges 99*a* decreases from the central portion to the peripheral portion. There may be areas where the number of the real bridges 99*a* formed between the strips are the same at the central portion and the peripheral portion.

The function of the tension mask for a color picture tube having the above structure is described below. Referring to FIG. 5, since the number of real bridges 73 connecting the strips 71 and 71' decreases from the central portion to the peripheral portion in the direction X, the tension mask 70 for a color picture tube can reduce transfer of vibrations generated by an impact applied to the tension mask 70 to the neighboring strip. In detail, in the conventional tension mask where the number of real bridges connecting strips is the same both at the central portion and the peripheral portion, vibrations are transferred in the same way as in a thin plate. However, in the tension mask 70 in the present invention, since the number of the real bridges 73 decreases from the central portion to the peripheral portion, the number of transmitting media for transferring vibrations decreases. Thus, in the present invention, vibrations transferred from the central portion to the peripheral portion or from the peripheral portion to the peripheral portion can be reduced so that an effect of vibration reduction can be obtained.

As shown in FIG. 6, since the protrusions 75*a* and 75*b* extending from the strips 71 and 71' in the opposite directions but not physically contacting each other are formed in the slot 72 defined by the real bridges 73, visibility can be improved. In detail, since the real bridges 73 shield electron beams emitted from an electron gun and the number of the real bridges 73 decreases from the central portion of the tension mask to the peripheral portion thereof in a state of an irregular arrangement, black dots appear on a screen. However, since the dummy bridges are installed between the slots, the black dots are uniformly distributed throughout the entire screen so that a viewer does not notice the black dots.

As shown in FIGS. 7 through 10, when the tension mask 80 (or 90) for a color picture tube is divided into a real bridge area 85 (or 94), a dummy bridge area 88 (or 96), and the aperture grille area 97, the transfer of vibrations can further be reduced. That is, since the strips 86 and 86' (or 194 and 194') are independently formed in the dummy bridge area 88 (or 96) and the aperture grille area 97, the transfer of vibrations between the strips 86 and 86' (or 194 and 194') can be prevented. Also, since the slot 98 of the aperture grille area 97 is formed of a single slot, numerical aperture (NA) according to deflection of an electron beam can be made great. That is, the numerical aperture can be large. The electron beam can be prevented from being shielded by the real bridges 93 and the dummy bridges 95 so that brightness at the peripheral portion of a screen can be improved. This improvement in brightness can prevent a decrease of the numerical aperture of the electron beam generated when an incident angle decreases when the electron beam is deflected by the deflection yoke toward the peripheral portion of the fluorescent film.

The number of the real bridges 85 connecting the strips 94 and 94' decreases from the central portion of the tension mask 80 to the peripheral portion thereof. A doming phenomenon due to thermal expansion of the tension mask 80 when the tension mask is heated by the electron beams emitted from the electron gun, can be reduced.

The number of the real bridges 94 connecting the strips 99 and 99' decreases from the central portion of the tension mask 90 to the peripheral portion thereof. A doming phenomenon due to thermal expansion of the tension mask 90 when the tension mask is heated by the electron beams emitted from the electron gun, can be reduced.

Refer now to FIG. 10. The strip A is close to the center of the dummy bridge area 96. The strip B is close to the rightmost edge of the dummy bridge area 96, as shown in FIG. 10. The strip C is close to the leftmost edge of the dummy bridge area 96, as shown in FIG. 10. The center of the dummy bridge area 96 has the highest concentration of real bridges 93 in the dummy bridge area 96. The concentration of real bridges 93 decreases in a first direction starting from the center of the dummy bridge area 96 and moving to the right toward the aperture grille area 97. The concentration of real bridges 93 also decreases in a second direction starting from the center of the dummy bridge area 96 and moving to the left toward the real bridge area 94.

In FIG. 10, the strip A is shown to have three real bridges 93 on the left and three real bridges 93 on the right. The strip B is shown to have two real bridges 93 on the left and no real bridges 93 on the right. The strip C is shown to have two real bridges 93 on the left and three real bridges 93 on the right.

The embodiment of the present invention shown in FIG. 10 shows that the number of real bridges 93 within the dummy bridge area 96 decreases as one moves from the center of the dummy bridge area 96 toward either one of the edges of the dummy bridge area 96.

The embodiment of the present invention shown in FIG. 10 shows that the number of real bridges 93 within the real bridge area 94 decreases as one moves from the center of the real bridge area 94 toward either one of the edges of the real bridge area 94. In other words, the highest concentration of the real bridges 93 in the real bridge area 94 is at the center of the real bridge area 94. Within the real bridge area 94, when an observer looks from the center of the real bridge area 94 toward the right toward the dummy bridge area 96 and the aperture grille area 97, the number of real bridges 93 per strip decreases. Also, within the real bridge area 94, when an observer looks from the center of the real bridge area 94 to the left, the number of real bridges 93 per strip decreases.

Figure 11:
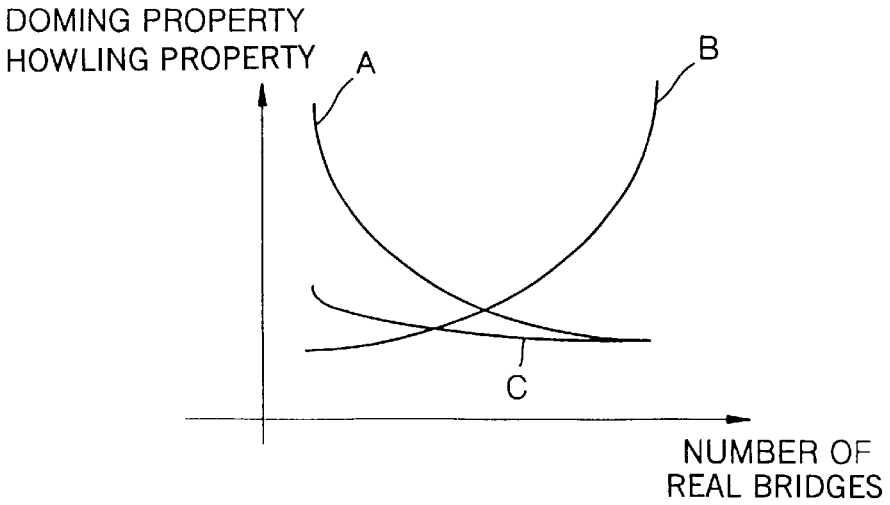
FIG. 11 is a graph showing the results of a comparison of a prior art mask and a mask having the features of the present invention, regarding a howling phenomenon and a doming phenomenon.

We have measured a do g phenomenon and a howling phenomenon generated in a state in which the tension mask having the above structure is installed at a picture tube and the results thereof are indicated in a graph of FIG. 11. FIG. 11 is a graph showing the results of a comparison of a prior art mask and mask having the features of the present invention, regarding a howling phenomenon and a doming phenomenon. As shown in the graph, the howling phenomenon is reduced as the number of the real bridges increases (refer to a curve A) while the doming phenomenon increases (refer to a curve B). When the number of the real bridges connecting the strips decreases along an axis X as in the tension mask of the present invention, the doming phenomenon and the howling phenomenon are remarkably decreased (refer to a curve C).

In the tension mask according to the present invention, since the number of the real bridges decreases from the central portion to the peripheral portion, Poisson contraction generated by tension applied when strips are installed at a frame can be reduced.

As described above, in the tension mask for a color picture tube according to the present invention, since the number of the real bridges decreases from the central portion to the peripheral portion, an effect of reducing the transfer of vibrations can be improved. Also, a moire phenomenon according to interference among the real bridges, the dummy bridges and a pattern of the fluorescent film can be reduced. In particular, during the initial driving of a picture tube, mis-landing, the doming phenomenon, and the moire phenomenon are not generated.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A tension mask apparatus for a color picture tube, the apparatus comprising:

a plurality of strips being separated a predetermined distance from each other and being parallel to each other;

a plurality of real bridges connecting adjacent ones of said strips and forming slots through which electron beams pass, a quantity of said real bridges gradually decreasing from a central portion of said tension mask to a peripheral portion of said tension masks;

a plurality of dummy bridges, each of said dummy bridges extending in opposite directions from adjacent ones of said strips partly into said slot separating said adjacent ones of said strips, each one of said dummy bridges comprising:

a first protruding portion; and a second protruding portion, said strips including a first strip adjacent to a second strip, said first strip being separated from said second strip by a first slot, said first protruding portion extending from said first strip into said first slot in a first direction, said second protruding portion extending from said second strip into said first slot in a second direction, said first and second directions being opposite to each other, said first and second protruding portions forming a dummy slot between said first and second protruding portions, said first and second protruding portions not physically contacting each other, said dummy slot being not centrally located between said first and second strips.

2. A tension mask apparatus for a color picture tube, the apparatus comprising:

a plurality of strips being separated a predetermined distance from each other and being substantially parallel to each other; and a plurality of real bridges connecting selected adjacent ones of said strips and forming slots through which electron beams pass, a quantity of said real bridges gradually decreasing from a central portion of said tension mask to a peripheral portion of said tension mask;

said plurality of strips including an end strip located at an outermost portion of said tension mask and including a strip adjacent to said end strip, said end strip and said strip adjacent to said end strip not being connected by said real bridges.

3. The apparatus of claim 1, with said real bridges having a highest concentration at a center of a dummy bridge area, with said dummy bridge area being spaced apart from a central portion of said tension mask, with concentration of said real bridges in said dummy bridge area decreasing in a direction away from said center of said dummy bridge area.

4. A tension mask apparatus for a color picture tube, comprising:

a plurality of strips being separated a predetermined distance from each other and being parallel to each other;

a real bridge area being located at a central portion of a tension mask, said real bridge area comprising a plurality of real bridges connecting neighboring ones of said strips in said real bridge area and forming slots through which electron beams pass, said real bridges being formed to gradually decrease in number in a direction from said central portion of said tension mask to a peripheral portion of said tension mask; and a dummy bridge area being located at said peripheral portion of said tension mask, said dummy bridge area comprising a plurality of dummy bridges extending from at least one side of each of said strips in said dummy bridge area and not physically contacting the opposite strip, said dummy bridge area further comprising an additional plurality of real bridges, said strips in said dummy bridge area being connected by said additional real bridges, said additional plurality of real bridges within said dummy bridge area having a highest concentration at a center of said dummy bridge area, a concentration of said plurality of real bridges decreasing in a direction away from said center of said dummy bridge area.

5. A tension mask apparatus for a color picture tube, comprising:

a plurality of strips being separated a predetermined distance from each other and being parallel to each other;

a real bridge area being located at a central portion of a tension mask, said real bridge area comprising a plurality of real bridges connecting neighboring ones of said strips in said real bridge area and forming slots through which electron beams pass, said real bridges being formed to gradually decrease in number in a direction from said central portion of said tension mask to a peripheral portion of said tension mask;

a dummy bridge area being located at said peripheral portion of said tension mask, said dummy bridge area comprising a plurality of dummy bridges extending from at least one side of each of said strips in said dummy bridge area and not physically contacting the opposite strip; and an aperture grille area being located near said dummy bridge area and having at least one slot formed by said strips, said tension mask being a hybrid type, said at least one slot in said aperture grille area not being divided by real bridges and not being divided by dummy bridges.

6. A tension mask apparatus, the apparatus comprising:

a plurality of strips being paced apart from each other, said strips including at least a first strip adjacent to a second strip, said strips forming slots penetrated by electron beams, said slots including at least a first slot located between said first and second strips, said tension mask including a central portion, two peripheral portions spaced apart from said central portion, and two intermediate areas, each one of said two intermediate areas separating said central portion from a respective one of said two peripheral portions, said two intermediate areas including a first intermediate area and a second intermediate area, said two peripheral portions including a first peripheral portion and a second peripheral portion, said first intermediate area separating said first peripheral portion from said central portion;

a plurality of real bridges connecting adjacent ones of said strips, with at least two of said real bridges being included in said central portion and in said two intermediate areas; and a plurality of dummy bridges including at least a first dummy bridge, with at least two of said dummy bridges being include in said peripheral portions, said first dummy bridge including a first protrusion and a second protrusion, said first protrusion extending in a first direction from said first strip into said first slot, said second protrusion extending in a second direction from said second strip into said first slot, said second direction being opposite to said first direction, said first and second protrusions forming a dummy slot between said first and second protrusions, said first and second protrusions not physically contacting each other, with said real bridges decreasing in concentration per unit area in directions leading from said central portion to said two intermediate areas, with the total number of said dummy bridges included in said first peripheral portion being larger than the total number of said dummy bridges included in said central portion and said two intermediate areas.

7. The apparatus of claim 6, with said two peripheral portions including all of said dummy bridges.

8. The apparatus of claim 7, with said protrusions having different lengths.

9. The apparatus of claim 6, with said central portion and said two intermediate areas including all of said real bridges.

10. The apparatus of claim 9, with said protrusions having different lengths.

11. The apparatus of claim 6, with said first peripheral portion including at least three of said real bridges.

12. The apparatus of claim 11, with said two peripheral portions including all of said dummy bridges.

13. The apparatus of claim 12, with said protrusions having different lengths.

14. The apparatus of claim 12, with said first peripheral portion having a highest concentration of said at least three real bridges at a center of said first peripheral portion, with concentration of said real bridges said first peripheral portion decreasing in a direction away from said center of said first peripheral portion.

15. The apparatus of claim 6, with said tension mask including an aperture grille area being spaced between said first peripheral portion and an outer edge of said tension mask, with said aperture grille area including at least two of said strips and at least one of said slots, with all of said real and dummy bridges being outside of said aperture grille area.

16. The apparatus of claim 15, with said two peripheral portions including all of said dummy bridges, and with said central portion and said two intermediate areas including all of said real bridges.

17. The apparatus of claim 16, with said protrusions having different lengths.

18. The apparatus of claim 15, with said protrusions having different lengths.

19. The apparatus of claim 6, with said tension mask including an aperture grille area being spaced between said first peripheral portion and an outer edge of said tension mask, with said aperture grille area including at least two of said strips and at least one of said slots, with said two peripheral portions including all of said dummy bridges, with said aperture grille area including at least one of said real bridges.

20. The apparatus of claim 19, with said first peripheral portion including at least three of said real bridges.

21. The apparatus of claim 20, with said first peripheral portion having a highest concentration of said at least three real bridges at a center of said first peripheral portion, with concentration of said real bridge in said first peripheral portion decreasing in a direction away from said center of said first peripheral portion.

22. The apparatus of claim 19, with said protrusions having different lengths.

23. The apparatus of claim 6, with said protrusions having different lengths.

* * * * *